US010046579B1

(12) United States Patent
Kono et al.

(10) Patent No.: US 10,046,579 B1
(45) Date of Patent: Aug. 14, 2018

(54) PRINTING APPARATUS

(71) Applicant: CANON KABUSHIKI KAISHA, Tokyo (JP)

(72) Inventors: Takeshi Kono, Yokohama (JP); Noriyuki Aoki, Tokyo (JP); Naoaki Wada, Yokohama (JP); Toshiaki Yamaguchi, Machida (JP); Masakazu Nagashima, Yokohama (JP); Ryohei Maruyama, Kawasaki (JP); Tomohito Abe, Yokohama (JP); Daigo Kuronuma, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/620,498

(22) Filed: Jun. 12, 2017

(30) Foreign Application Priority Data

Jun. 9, 2017 (JP) ..... 2017-114552

(51) Int. Cl.
*B41J 2/175* (2006.01)
*B41J 25/00* (2006.01)
*B41J 2/145* (2006.01)

(52) U.S. Cl.
CPC ..... *B41J 25/006* (2013.01); *B41J 2/145* (2013.01); *B41J 2/17523* (2013.01)

(58) Field of Classification Search
CPC . B41J 25/006; B41J 2/145; B41J 2/175; B41J 2/17513; B41J 2/1752; B41J 2/17523; B41J 2/165
See application file for complete search history.

(56) References Cited

U.S. PATENT DOCUMENTS 9,114,621 B2 * 8/2015 Shimizu ..... B41J 2/17509

FOREIGN PATENT DOCUMENTS

JP 2006-159603 6/2006

* cited by examiner

*Primary Examiner* — Thinh H Nguyen
(74) *Attorney, Agent, or Firm* — Fitzpatrick, Cella, Harper & Scinto

(57) ABSTRACT

A printing apparatus includes: a printhead; a carriage, on which the printhead is mounted; a first containing unit configured to contain ink to be supplied to the printhead; and a channel forming unit which forms an ink supply channel for supplying ink to the printhead. The channel forming unit includes: a first tube which extends in a reciprocation direction of the carriage; a second tube which is connected to the first containing unit; and a first coupling member which couples the first tube and the second tube to each other. The first coupling member is located in one end portion of the printing apparatus in the reciprocation direction, and has a bent channel which connects the first tube and the second tube to each other.

13 Claims, 13 Drawing Sheets

PRINTING APPARATUS

BACKGROUND OF THE INVENTION

Field of the Invention

The present invention relates to a printing apparatus.

Description of the Related Art

A method for supplying ink from an ink containing portion to a printhead through a flexible tube is known as an ink supply method that can be employed in an ink jet printing apparatus (for example, Japanese Patent Laid-Open No. 2006-159603). Such an ink supply method is mainly employed in relatively large printing apparatuses that print images on a large printing medium.

Since a printhead is mounted on a carriage and reciprocates, a channel that extends in a reciprocation direction of the carriage, and a channel that is diverted from the aforementioned channel toward the ink containing portion, are required as ink supply channels. A tube that causes a small pressure drop and has high gas barrier properties is advantageous as a tube that forms an ink channel. However, generally, such a tube tends to have a large diameter and be hard. Therefore, when a hard tube with a large diameter is employed in the area where a channel is to be diverted as described above, the tube needs to be bent along a large curve, which leads to an increase in the size of the apparatus because a large space needs to be secured.

SUMMARY OF THE INVENTION

The present invention provides technology for downsizing an apparatus with forming an ink channel.

According to an aspect of the present invention, there is provide a printing apparatus comprising: a printhead configured to perform printing by discharging ink onto a printing medium; a carriage, on which the printhead is mounted, configured to reciprocate; a first containing unit configured to contain ink to be supplied to the printhead; and a channel forming unit configured to form an ink supply channel for supplying ink to the printhead, wherein the channel forming unit includes: a first tube which extends in a reciprocation direction of the carriage; a second tube which is connected to the first containing unit; and a first coupling member which couples the first tube and the second tube to each other, and wherein the first coupling member is located in one end portion of the printing apparatus in the reciprocation direction, and includes a bent channel which communicates the first tube and the second tube to each other.

Further features of the present invention will become apparent from the following description of exemplary embodiments (with reference to the attached drawings).

DESCRIPTION OF THE EMBODIMENTS

Figure 1:
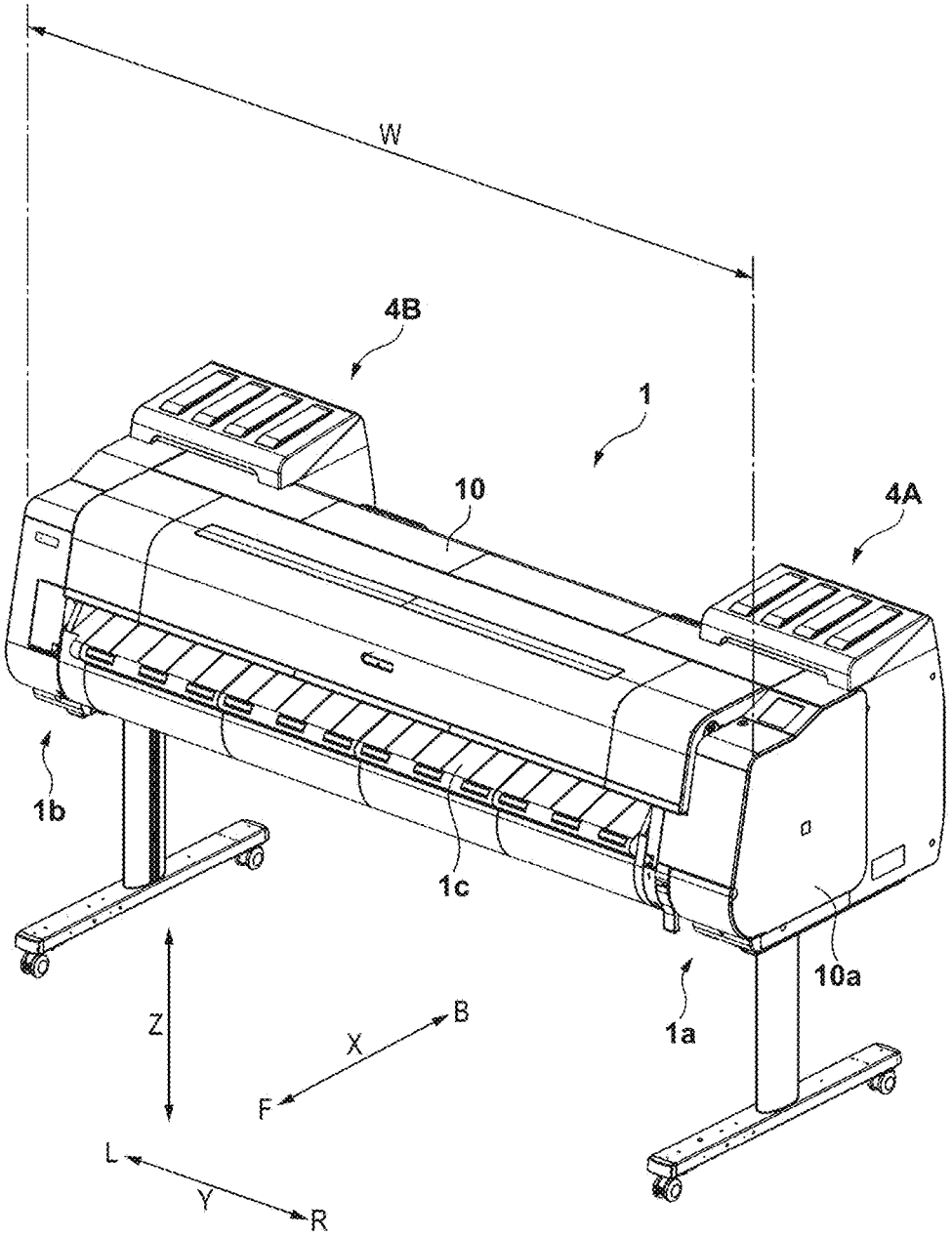
FIG. 1 is an external view of a printing apparatus according to an embodiment of the present invention.

Following describes a printing apparatus according to embodiments of the present invention with reference to the drawings. In the drawings, arrows X, Y, and Z respectively indicate a front-rear direction (a depth direction), a left-right direction (a width direction, which is the lengthwise direction of the apparatus), and a top-bottom direction in a front view of the printing apparatus. Also, "F" indicates the front side, "B" indicates the rear side, "L" indicates the left side, and "R" indicates the right side.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "printing media" are assumed to be paper sheets but may be fabrics, plastic films, and the like.

Overview of Printing Apparatus

Figure 2:
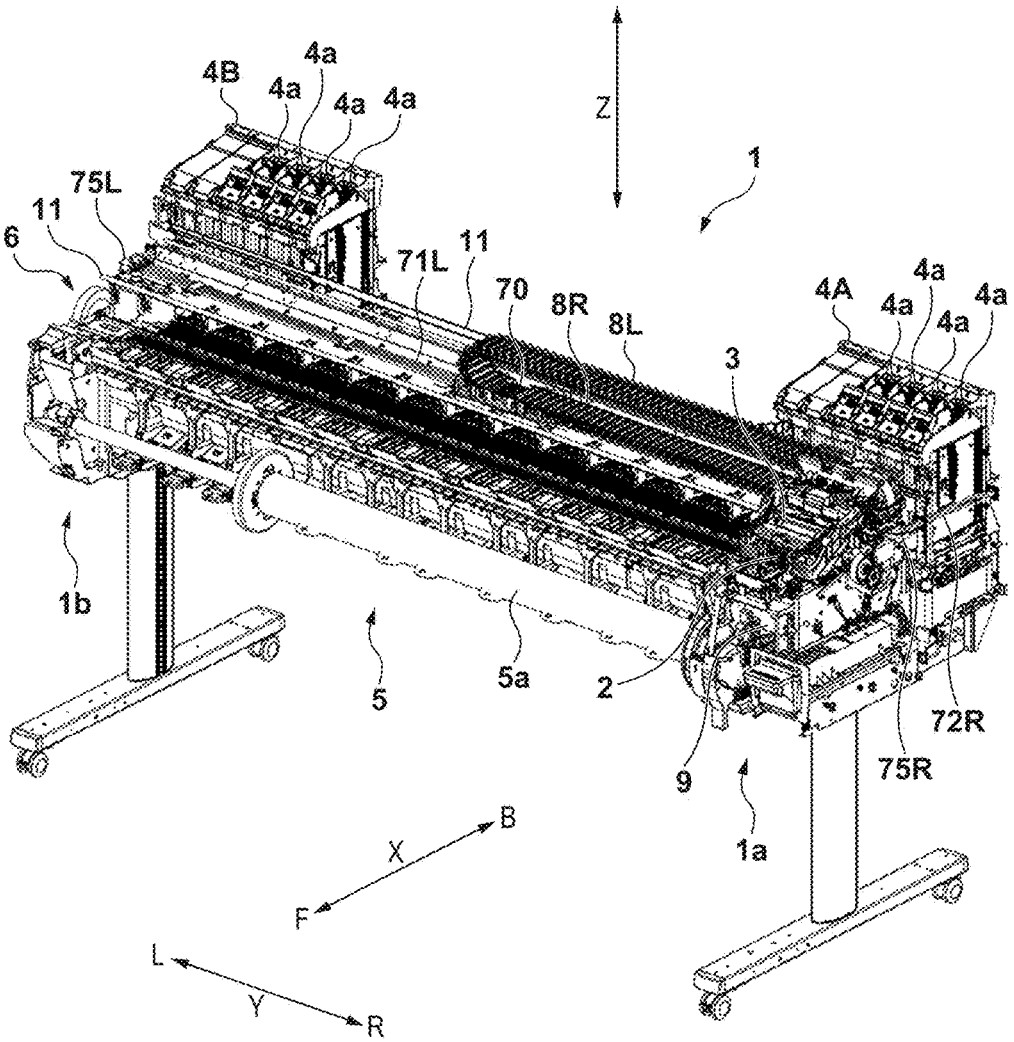
FIG. 2 is a perspective view showing an internal structure of the printing apparatus in FIG. 1.

FIG. 1 is an external view of a printing apparatus 1 according to the present embodiment. FIG. 2 is a perspective view showing the internal structure of the printing apparatus 1, and shows a situation where a cover member 10 has been removed from FIG. 1. The cover member 10 forms an outer casing of the printing apparatus 1, and encloses the internal structure.

The printing apparatus 1 is a serial ink jet printing apparatus, and includes a printhead 2, a carriage 3, ink supply units 4A and 4B, a feeding mechanism 5, a conveyance mechanism 6, and a recovery mechanism 9. The printing apparatus 1 has a right end portion 1*a* and left end portion 1*b*, which are one end portion and the other end portion in the Y direction.

The feeding mechanism 5 and the conveyance mechanism 6 are mechanisms for conveying a printing medium. In the present embodiment, a printing medium is conveyed in the X direction. The feeding mechanism 5 includes a sheet attachment portion 5*a*. A printing medium that is wound into a roll (a roll sheet) can be attached to the sheet attachment portion 5*a*. The printing apparatus 1 is an apparatus that can print images onto a printing medium that has a large size such as the A0 size or the B0 size.

The feeding mechanism 5 includes, for example, a feeding roller that conveys a printing medium, and a guide that forms a conveyance path of a printing medium and guides the printing medium moving. In the present embodiment, the feeding mechanism 5 first conveys the printing medium, which is attached to the sheet attachment portion 5*a*, rearward in the X direction, thereafter bends the printing medium upward, and then conveys the printing medium forward in the X-direction.

The conveyance mechanism 6 includes, for example, a feeding roller that conveys a printing medium, and a guide that forms a conveyance path of a printing medium and guides the printing medium moving. The conveyance mechanism 6 conveys a printing medium that has been fed by the feeding mechanism 5, and discharges the printing medium from a discharging portion 1*c*. The printhead 2 prints images onto a printing medium while the conveyance mechanism 6 conveys the printing medium.

The printhead 2 has a plurality of orifices from which ink is discharged, and prints an image by discharging ink onto a printing medium that is conveyed by the conveyance mechanism 6. The printhead 2 is mounted on the carriage 3.

The carriage 3 is configured to reciprocate in the Y direction by being guided by a plurality of guide shafts 11 that extend along the Y direction. A driving mechanism for moving the carriage 3 includes a motor and a belt transmission mechanism, for example. The belt transmission mechanism includes a driving pulley, a driven pulley, and a belt wound around these pulleys. The carriage 3 is fixed to a portion of the belt, and moves due to the belt running.

The recovery mechanism 9 is located on the right end portion 1*a* of the printing apparatus 1. The recovery mechanism 9 is a mechanism for maintain and recover ink discharge performance of the printhead 2. The recovery mechanism 9 includes a cap and a wiper, for example. Operations to maintain and recover the ink discharge performance of the printhead 2 include a preliminary discharge operation and a cleaning operation, for example. The preliminary discharge operation is an operation to discharge ink from the printhead 2. The cleaning operation is an operation to cap the printhead 2 using the cap, to suck ink from the printhead 2 under negative pressure, or to wipe the ink discharge surface of the printhead 2 using the wiper.

The ink supply units 4A and 4B are sources of ink that is discharged by the printhead 2. The ink supply units 4A and 4B each include six attachment portions to which ink tanks 4*a* are respectively attached. Therefore, twelve types of ink are available at the maximum. In the example shown in the drawing, ink tanks 4*a* are respectively attached to four attachment portions in the six attachment portions.

In the present embodiment, the ink supply units 4A and 4B are located at the rear side of the printing apparatus 1 rather than the carriage 3. This location makes it possible to reduce a width w of the printing apparatus 1 and downsize the apparatus compared to when the ink supply units 4A and 4B are located sideward of the carriage 3 in the Y direction. The ink supply unit 4A is located in a rear portion of the right end portion 1*a* of the printing apparatus 1, and the ink supply unit 4B is located in a rear portion of the left end portion 1*b* of the printing apparatus 1. It is possible to form the ink supply channels to the printhead 2 in a balanced manner by symmetrically arranging the ink supply units 4A and 4B in the Y direction.

When printing onto a printing medium is performed using the above-described configuration, the printing medium is conveyed to a predetermined printing start position by the conveyance mechanism 6. Thereafter, an operation to discharge ink while moving the printhead 2 in the Y direction using the carriage 3 and an operation to move the printing medium forward in the X direction using the conveyance mechanism 6 are repeated, and thus printing onto the entire printing medium is performed.

Ink Supply System

Figure 3:
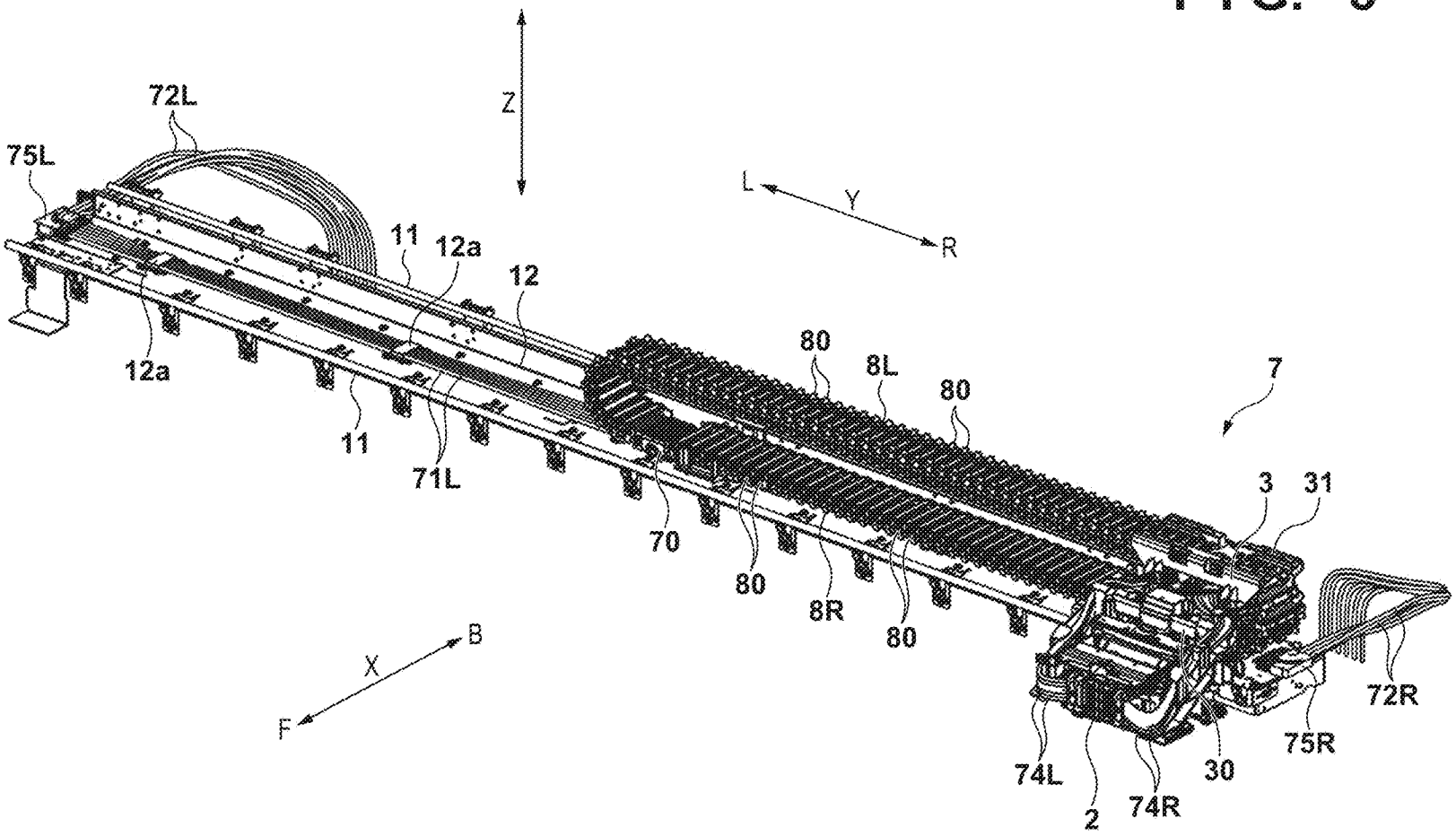
FIG. 3 is a perspective view showing a structure of an ink supply system of the printing apparatus in FIG. 1.
Figure 4:
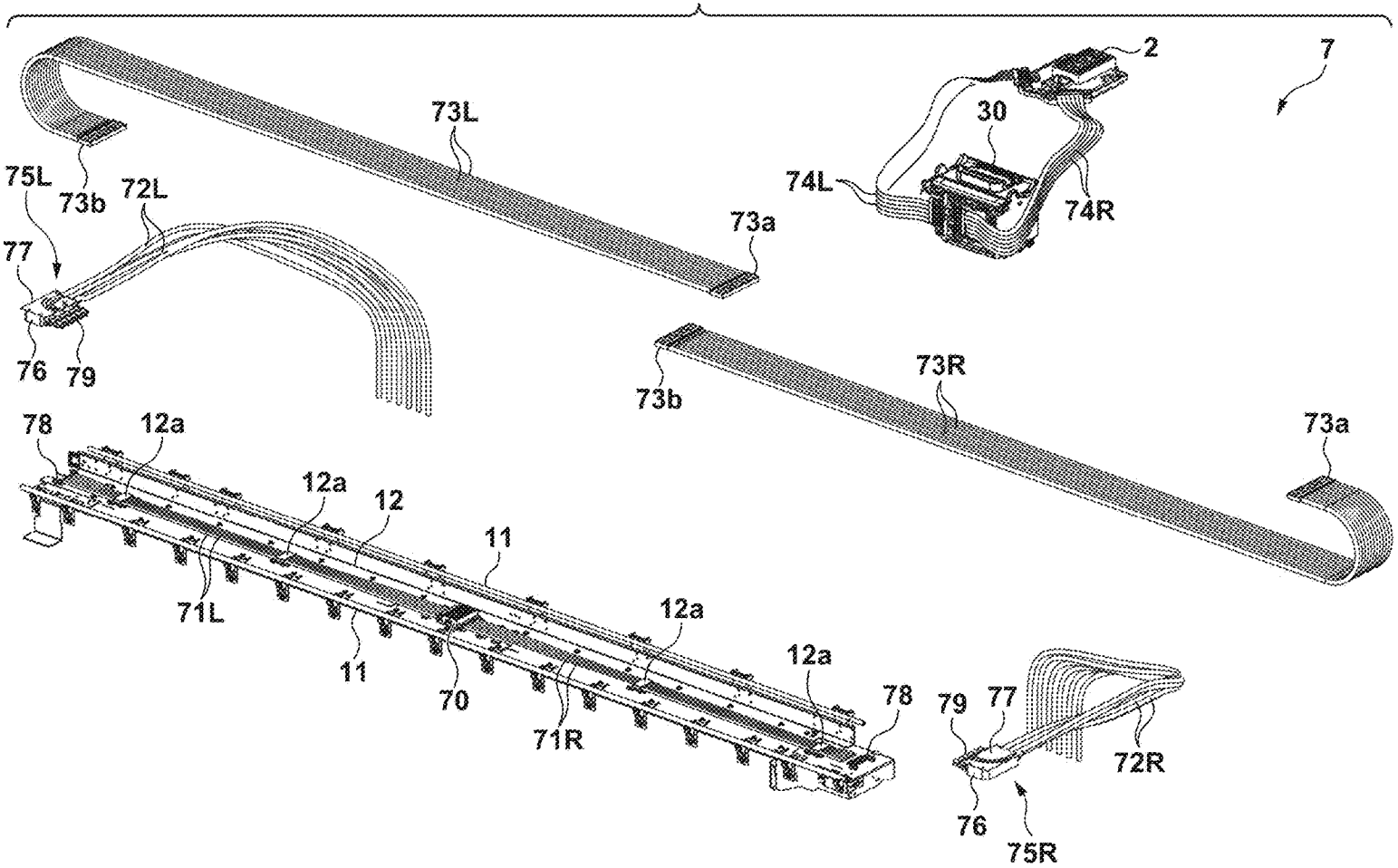
FIG. 4 is an exploded perspective view of the structure of the ink supply system shown in FIG. 3.
Figure 5:
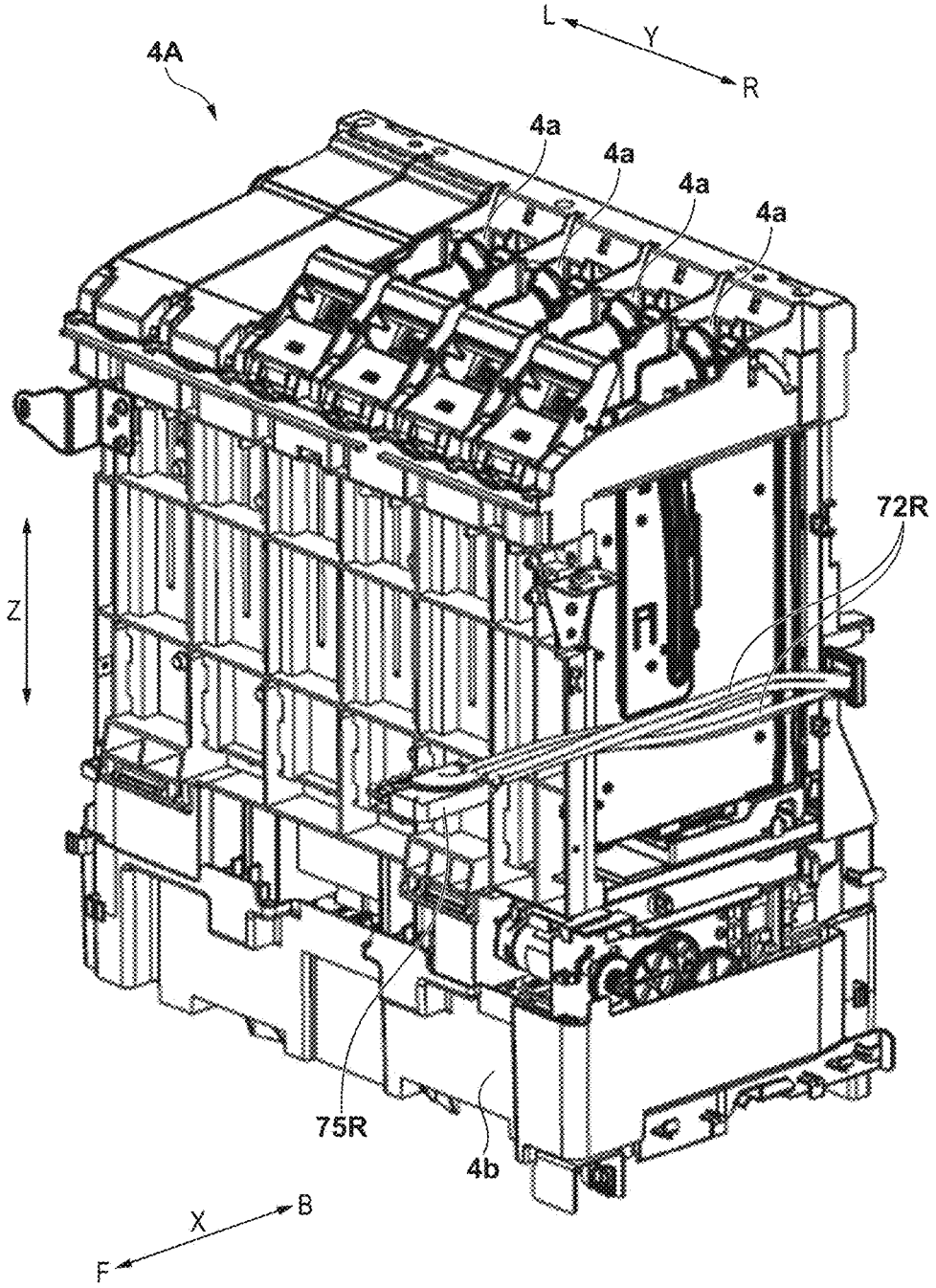
FIG. 5 is a perspective view of an ink supply unit.
Figure 6:
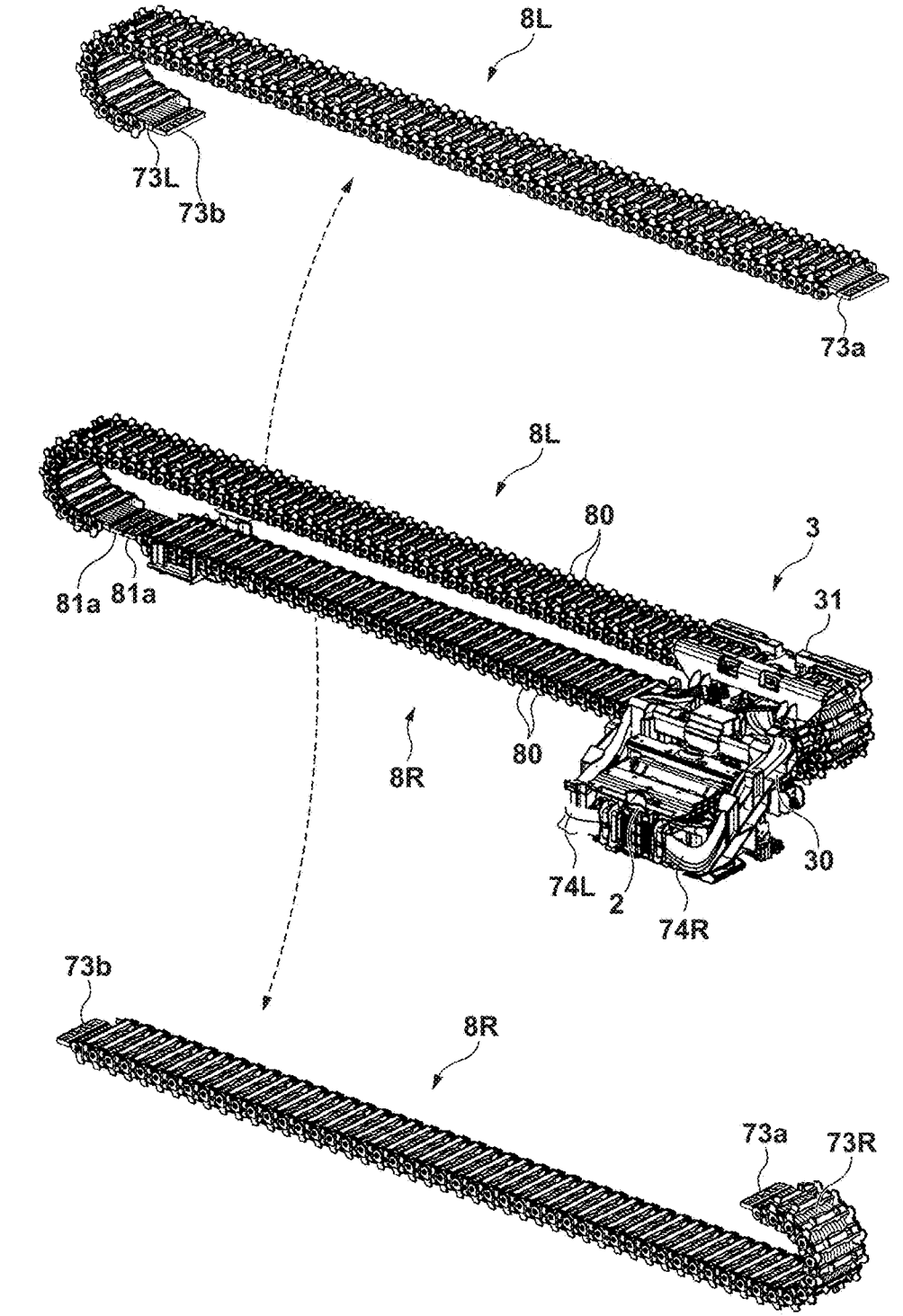
FIG. 6 is a perspective view showing a structure around a carriage.

The following describes an ink supply system for supplying ink from the ink supply units 4A and 4B to the printhead 2 with reference to FIGS. 2 and 3 to 6. FIG. 3 is a perspective view showing a structure of an ink supply system of the printing apparatus 1, FIG. 4 is an exploded perspective view of the structure shown in FIG. 3, and FIG. 5 is a perspective view of the ink supply unit 4A. FIG. 6 is a perspective view showing a structure around the carriage 3.

The printing apparatus 1 includes a channel forming unit 7 that forms ink supply channels for supplying ink from the ink supply units 4A and 4B to the printhead 2.

The channel forming unit 7 includes tubes 71R to 74R and a coupling member 75R that form channels from the ink supply unit 4A to the printhead 2, and tubes 71L to 74L and a coupling member 75L that form channels from the ink supply unit 4B to the printhead 2. The channel forming unit 7 also includes a coupling member 70 that is shared between these two channel systems.

Ink is supplied from the ink supply unit 4A to the printhead 2 through the plurality of tubes 72R, the coupling member 75R, the plurality of tubes 71R, the coupling member 70, the plurality of tubes 73R, the carriage 3, the plurality of tubes 74R, and the printhead 2, in this order. The number of tubes 71R to 74R is greater than or equal to the number of types of ink in the ink supply unit 4A. Ink is supplied from the ink supply unit 4B to the printhead 2 through the plurality of tubes 72L, the coupling member 75L, the plurality of tubes 71L, the coupling member 70, the plurality of tubes 73L, the carriage 3, the plurality of tubes 74L, and the printhead 2, in this order. The number of tubes 71L to 74L is greater than or equal to the number of types of ink in the ink supply unit 4B.

The tubes 71R and 71L extend straight in the Y direction. The printing apparatus 1 include a frame 12 that supports the tubes 71R and 71L. In the present embodiment, the frame 12 is a plate member that extends in the Y direction in a belt-like shape, and is made of metal, for example. The tubes 71R and 71L are placed on the upper surface of the frame 12.

Restriction members 12*a* that restrict the tubes 71R and 71L from being displaced in a direction that intersects the Y direction are respectively fixed to a plurality of positions of the frame 12. The restriction members 12*a* are members that each have an inverted U shape (or a gate shape), and gaps that allow the tubes 71R or 71L to pass through are formed between the frame 12 and the restriction members 12*a*. The restriction members 12*a* restrict the tubes 71R or 71L from being lifted, and from being displaced in the X direction. It is possible to prevent the tubes 71R and 71L from interfering with components around the tubes 71R and 71L by restricting the tubes 71R and 71L from being displaced. The tubes 71R and 71L may expand and contract depending on the thermal environment in which the tubes 71R and 71L are used. Therefore, the restriction members 12*a* do not restrict the tubes 71R and 71L from being displaced in the Y direction.

The coupling member 70 is located in a central portion of the printing apparatus 1 in the Y direction. The ends of the tubes 71R and 71L on the central portion side are connected to the coupling member 70. The tubes 71R extend from the coupling member 70 to the end portion 1*a* of the printing apparatus 1, and the ends of the tubes 71R are connected to the coupling member 75R. The tubes 71L extend from the coupling member 70 to the end portion 1*b* of the printing apparatus 1, and the ends of the tubes 71L are connected to the coupling member 75L.

The tubes 72R connect the tubes 71R and the ink supply unit 4A to each other, and the tubes 72L connect the tubes 71L and the ink supply unit 4B to each other. The ends of the tubes 72R on one side are connected to the coupling member 75R. The tubes 72R extend from the coupling member 75R in a direction that intersects the direction in which the tubes 71R extend (in the present embodiment, rearward in the X direction), runs to the rear side of the ink supply unit 4A, and is connected to the ink supply unit 4A. The ends of the tubes 72L on one side are connected to the coupling member 75L. The tubes 72L extend from the coupling member 75L in a direction that intersects the direction in which the tubes 71L extend (in the present embodiment, rearward in the X direction), runs to the rear side of the ink supply unit 4B, and is connected to the ink supply unit 4B.

As shown in FIG. 5, ink containing portions 4*b* that are configured to contain ink from the ink tanks 4*a* are provided in a lower portion of the ink supply unit 4A. The ink containing portions 4*b* are ink containing spaces that are formed respectively corresponding to the ink tanks 4*a* (the attachment portions). The ink containing portions 4*b* may be storages that are configured to store a predetermined amount of ink, or substantially only relay channels between the ink tanks 4*a* and the tubes 72R. The rear ends of the tubes 72R are connected to the ink containing portions 4*b*, on the back side of the ink supply unit 4A. The tubes 72L and the ink supply unit 4B have the same configurations as described above.

The tubes 73R connect the tubes 71R and the carriage 3 to each other, and the tubes 73L connect the tubes 71L and the carriage 3 to each other. Connection members 73*a* and 73*b* for connecting channels are provided at ends of the tubes 73R and 73L. The connection members 73*a* are connected to the carriage 3, and the connection members 73*b* are connected to the coupling member 70.

The tubes 73R and 73L are bent and protrude in the Y direction in a U shape, and deform according to the back and forth movement of the carriage 3 while changing the bending positions. The printing apparatus 1 includes tube holding members 8R and 8L to guide the tubes 73R and 73L deforming according to the back and forth movement of the carriage 3.

In the present embodiment, the tube holding members 8R and 8L are chain links (cable carriers) that each include a plurality of link members 80 that are coupled to each other. The link members 80 each have a ring-like shape that allows tubes to be inserted thereinto, and adjacent link members 80 are coupled to each other so as to be rotatable relative to each other about an axis that extends in the X direction. The tube holding members 8R and 8L are bent and protrude in the Y direction in a U shape, and deform according to the back and forth movement of the carriage 3 while changing the bending positions. The tubes 73R are inserted into the tube holding member 8R, and the tubes 73L are inserted into the tube holding member 8L. The tube holding members 8R and 8L prevent the tubes 73R and 73L from swelling, and guide the tubes 73R and 73L deforming. The carriage 3 is provided with a guide portion 31 in a main body 30 on which the printhead 2 is mounted. The guide portion 31 prevents the tube holding members 8R and 8L from being lifted.

The tubes 74R connect the carriage 3 and the printhead 2 to each other, and the tubes 74L connect the carriage 3 and the printhead 2 to each other. In the present embodiment, the tubes 73R and the tubes 74R are connected to each other through the carriage 3. The carriage 3 includes portions that are connected to these tubes, and channels. The same applies to the tubes 73L and the tubes 73R.

All of the tubes 71R to 74R and 71L to 74L are flexible resin tubes. All of the tubes may be the same or different. Generally, a tube that causes a small pressure drop and has high gas barrier properties is advantageous as a tube that forms an ink channel. However, generally, such a tube tends to have a large diameter, to be hard, and to be expensive. Therefore, a different type of tube may be used depending on the position.

For example, the tubes 71R and 71L extend straight, and do not move when the carriage 3 moves. Therefore, it is possible to use tubes that are thick (have a large channel diameter) and hard (have high gas barrier properties). The tubes 73R and 73L are repeatedly bent according to the movement of the carriage 3. Therefore, highly flexible tubes are advantageous. The tubes 72R, 72L, 74R, and 74L need to be statically bent, but need not to be dynamically bent. Therefore, a certain degree of flexibility suffices. From the above-described point of view, the tubes may have, for example, the following relationship in terms of thickness: the tubes 71R (thick)>the tubes 72R and 74R≥the tubes 73R (thin), or the tubes 71R (thick)>the tubes 72R and 74R>the tubes 73R (thin). Also, the following relationship in terms of the gas barrier properties (hardness) may be satisfied: the tubes 71R (hard)>the tubes 72R and 74R≥the tubes 73R (soft), or the tubes 71R (hard)>the tubes 72R and 74R>the tubes 73R (soft). The same applies to the tubes 71L to 74L. Alternatively, the tubes 71R and the tubes 71L, the tubes 72R and the tubes 72L, the tubes 73R and the tubes 73L, the tubes 74R and the tubes 74L respectively have the same thickness and hardness.

The coupling members 70, 75R, and 75L are relay members that connect tubes. These coupling members can be formed using block-shaped hard synthetic resins in which ink channels are formed, for example. In the present embodiment, the coupling member 70 is fixed to the frame 12, whereas the coupling members 75R and 75L are not fixed and are placed on the frame 12.

Figure 7:
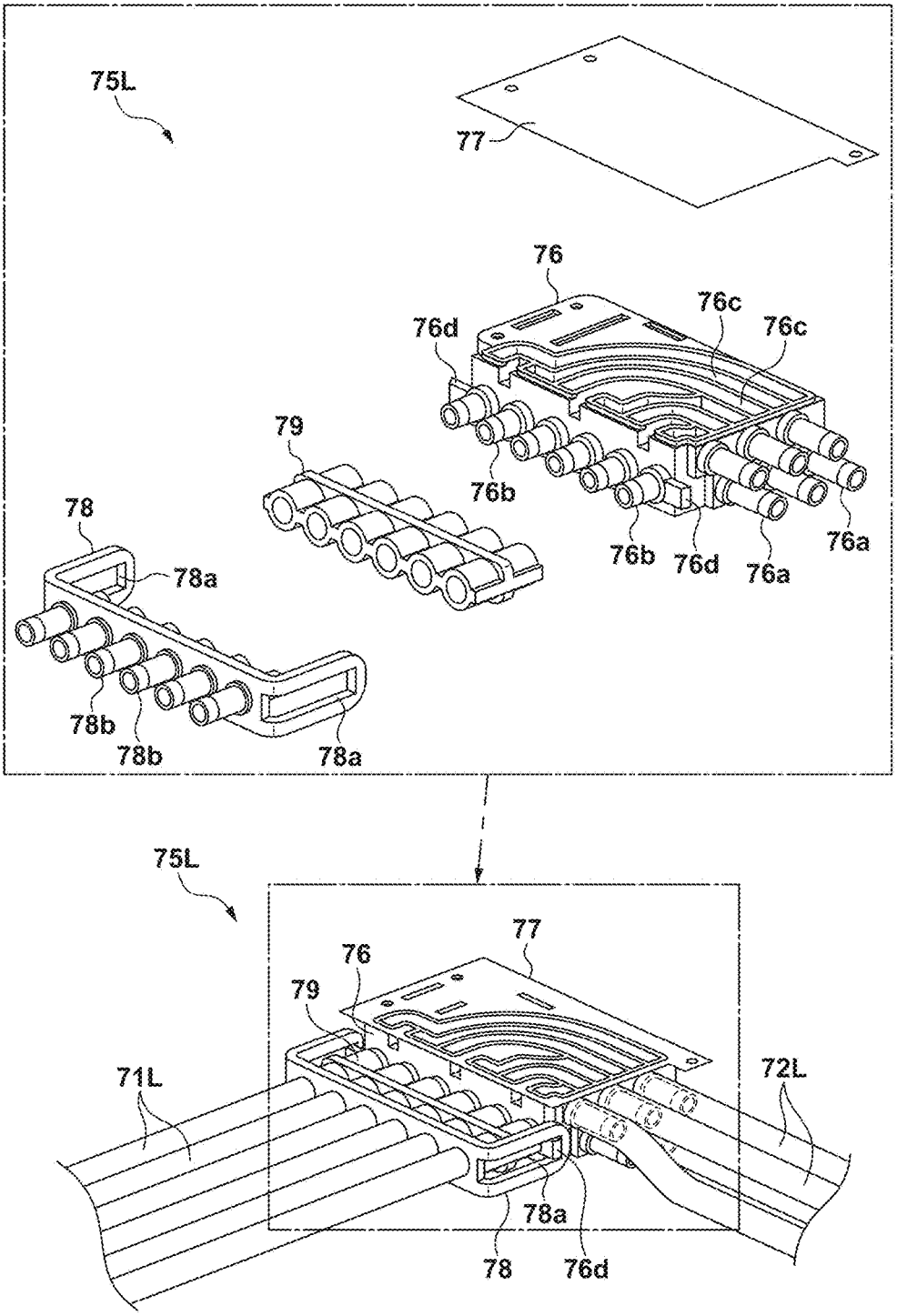
FIG. 7 is a diagram illustrating a coupling member.

The following describes the configuration of the coupling member 75L with reference to FIG. 7. FIG. 7 illustrates the coupling member 75L, and shows a disassemble state and an assembled state. The coupling member 75R have the same configuration as the coupling member 75L (reversed in the left-right direction).

The coupling member 75L includes a main member 76, a cover sheet 77, a connection member 78, and an elastic member 79. The main member 76 is a member in which a plurality of grooves 76*c* that serve as internal channels are formed, and is formed using a hard synthetic resin (e.g. a polypropylene resin). The main member 76 includes a plurality of cylindrical connection portions 76*a* to which the tubes 72L are connected, and a plurality of cylindrical connection portions 76*b* on the tubes 71L side. The axial direction of the connection portions 76*a* is the X direction, and the direction in which the connection portions 76*a* and the tubes 72L are connected is the X direction. The grooves 76*c* are formed such that connection portions 76*a* and the connection portions 76*b* communicate with each other, and are open in the upper surface of the main member 76.

The cover sheet 77 is a film that closes the openings of the grooves 76*c*, and is, for example, a thin film that is made of a synthetic resin on which aluminum has been deposited using vapor deposition, and is welded to the upper surface of the main member 76. To form the internal channels, it is possible to form closed holes in the main member 76 instead of the grooves 76*c*. However, it is possible to more easily manufacture the main member 76 by combining the grooves 76*c* with the cover sheet 77 as in the present embodiment.

In the present embodiment, the axial direction of the connection portions 76*a* and the axial direction of the connection portions 76*b* are orthogonal to each other, and the external shape of each of the grooves 76*c* is the shape of a 90 degree arc that curves from one end to the other end. In the present embodiment, channels that are bent by 90 degrees are formed by the grooves 76*c* and the cover sheet 77. The degree of curvature of the channels can be determined according to the angle of intersection of the tubes 71L and the tubes 72L. If a sharp curve is required, the degree of curvature of the channels may be selected from the range of 70 degrees to 110 degrees, or the range of 80 degrees to 100 degrees, for example.

A configuration in which the tubes 71L are directly connected to the connection portions 76*b* may be employed. However, in the present embodiment, the elastic member 79 and the connection member 78 are intervened therebetween. This configuration makes it easier to separate the tubes 71L and the tubes 72L from each other at the time of maintenance.

The connection member 78 includes a plurality of cylindrical connection portions 78*b* to which the tubes 71L are connected, and is formed using a hard synthetic resin (e.g. a polyacetal resin). The axial direction of the connection portions 78*b* is the Y direction, and the direction in which the connection portions 78*b* and the tubes 71L are connected is the Y direction. The connection member 78 includes engagement portions 78*a* that engage with engagement portions 76*d* of the main member 76. The engagement portions 76*d* are claw-shaped protruding pieces, and the engagement portions 78*a* are openings into which the engagement portions 76*d* are inserted. The engagement portions 78*a* are slits that extend in the Y direction, and the connection member 78 are engaged with the main member 76 so as to be displaceable in the Y direction.

The elastic member 79 is a rubber member that includes cylindrical connection portions that respectively connect the connection portions 78*b* and the connection portions 76*b* to each other. Due to the elastic member 79 being intervened between the connection member 78 and the main member 76, the connection member 78 and the main member 76 are biased by the elastic member 79 in directions away from each other. Thus, the connection member 78 and the main member 76 are locked to each other. The elastic member 79 also secure the sealing properties of the channels.

Next, displacement restriction structures for the coupling members 75R and 75L will be described. The coupling members 75R and 75L are basically placed on the frame 12 without being fixed, and are configured to be displaceable in the Y direction according to thermal contraction of the tubes 71R and 71L. However, if the coupling members 75R and 75L are unnecessary displaced, the tubes may become detached or interfere with components around the tubes. Therefore, in the present embodiment, the coupling members 75R and 75L are configured to be displaceable in the Y direction and restricted from being displaced in the X direction that intersects the Y direction.

Figure 8:
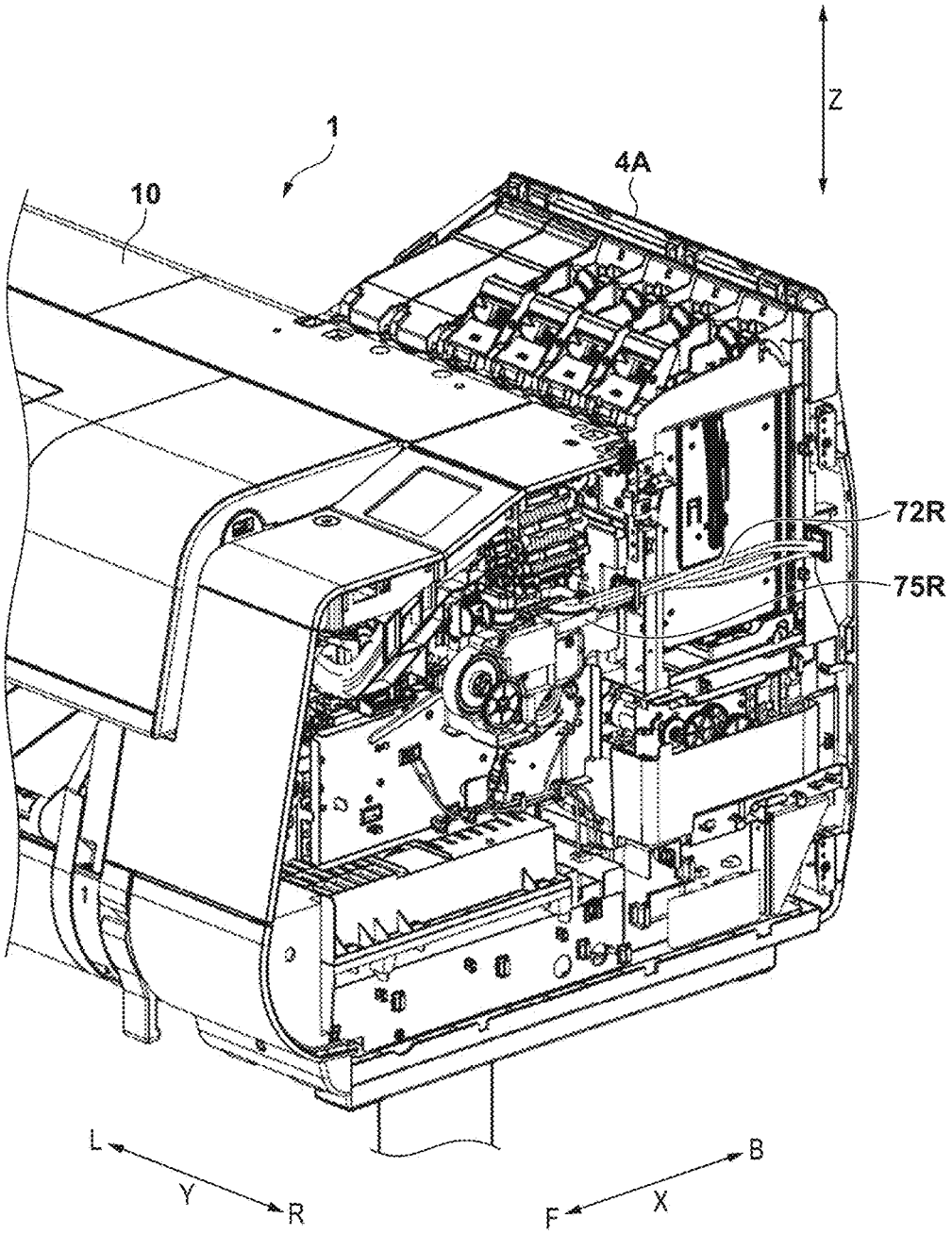
FIG. 8 is a diagram showing a situation where a right outer cover of the printing apparatus in FIG. 1 has been removed.
Figure 9:
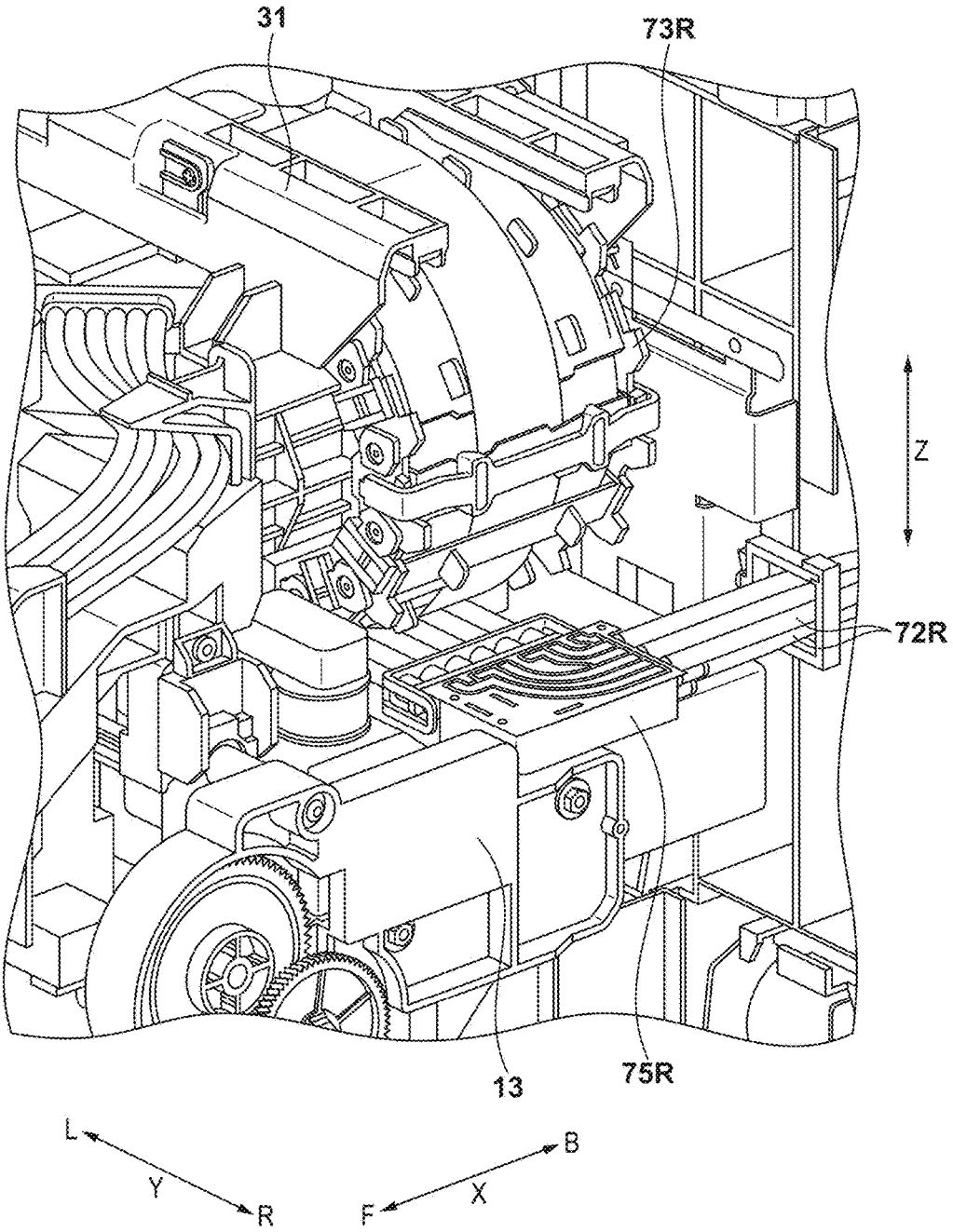
FIG. 9 is a diagram illustrating a restriction structure that restricts a right coupling member from being displaced.

The following describes the displacement restriction structure for the coupling member 75R with reference to FIGS. 8 and 9. FIG. 8 is a perspective view showing a situation where a cover member 10*a* has been removed, and FIG. 9 is a perspective view showing a structure around the coupling member 75R.

Note that the cover member 10*a* is a portion of the cover member 10, and forms an outer casing for a right portion of the printing apparatus 1. In the present embodiment, the coupling member 75R is located at the rightmost end of the internal structure of the printing apparatus 1. The coupling member 75R is located so as to face the inner surface of the cover member 10*a*, and so as to be exposed when the cover member 10*a* is removed. Thus, a configuration that makes it easier to access the coupling member 75R at the time of maintenance is employed.

Also, as with the coupling member 75L described with reference to FIG. 7, the coupling member 75R is also configured such that the main member 76 thereof can be separated from the connection member 78 in the Y direction. Therefore, at the time of maintenance, it is possible to separate the tubes 71R and the tubes 72R from each other by separating the main member 76 of the coupling member 75R from the connection member 78 to, for example, replace the tubes 72R. Note that a left portion of the printing apparatus 1 has the same configuration, and the coupling member 75L is exposed when the cover member for the left portion is removed.

A component part 13 that forms the recovery mechanism 9 is located forward of the coupling member 75R in the X direction. The component part 13 has a rear surface that faces the front surface of the coupling member 75R, and restricts the coupling member 75R from being displaced forward. That is, the component part 13 also serves as a restriction member that restricts the coupling member 75R from being displaced forward. In this way, by using the component part 13, which has another purpose, as the restriction member, it is possible to restrict the coupling member 75R from being displaced, without increasing the number of parts. Note that the coupling member 75R is not restricted from being displaced rearward because the tubes 72R are located rearward of the coupling member 75R.

Figure 10:
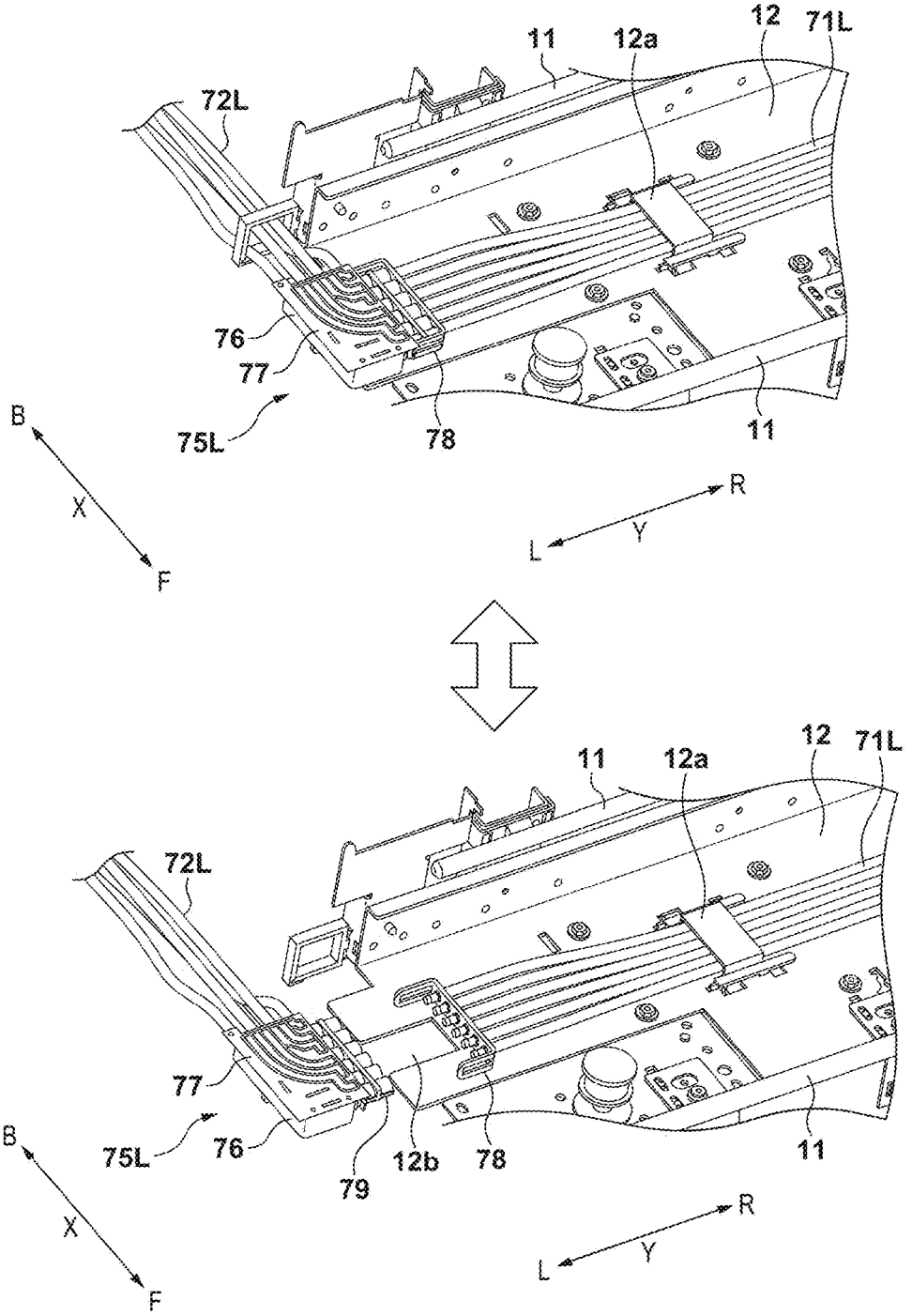
FIG. 10 is a diagram illustrating a restriction structure that restricts a left coupling member from being displaced.
Figure 11:
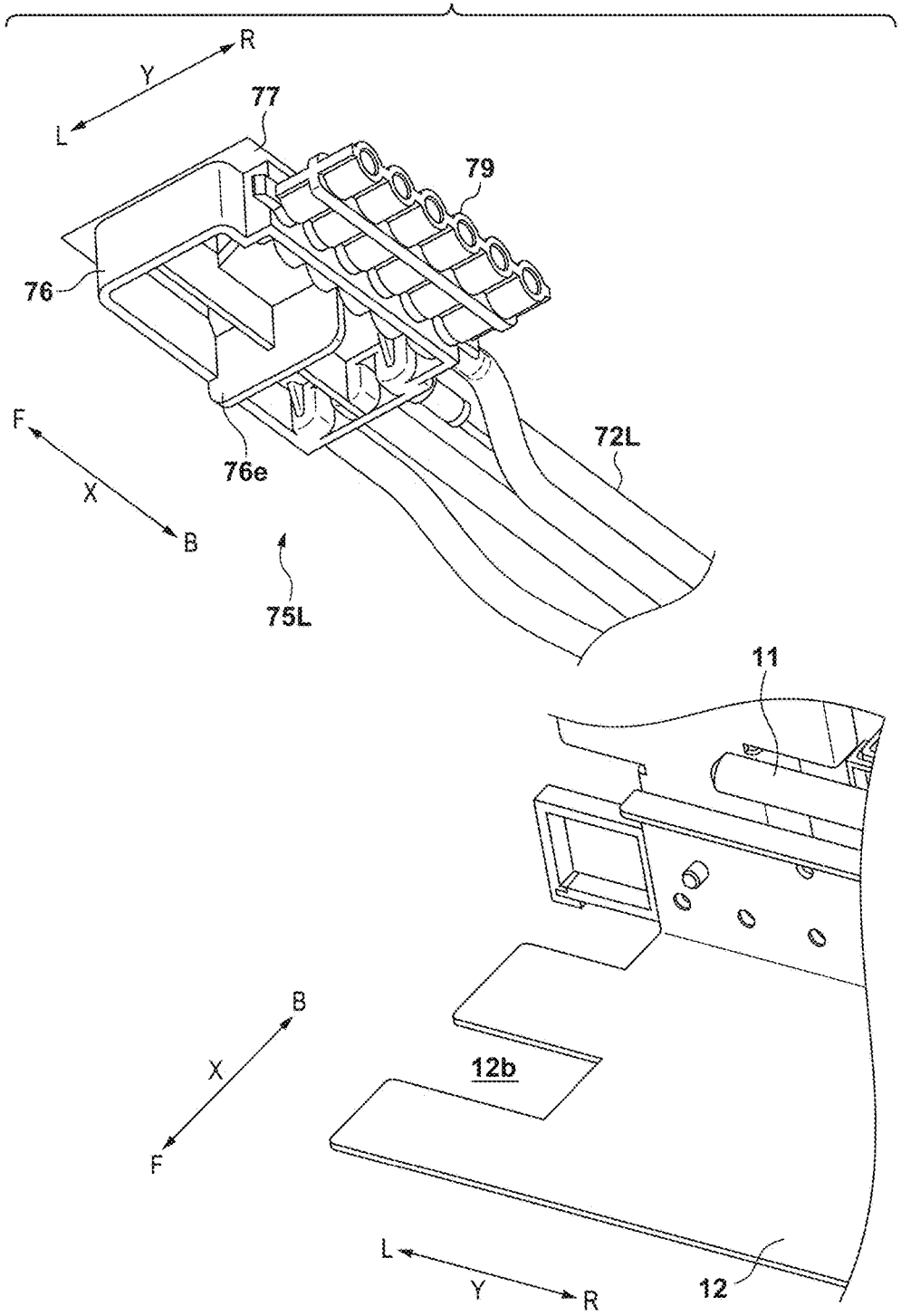
FIG. 11 is a diagram illustrating the restriction structure that restricts the left coupling member from being displaced.

The following describes the displacement restriction structure for the coupling member 75L with reference to FIGS. 10 and 11. FIG. 10 illustrates a mode of separation of the coupling member 75L is separated, and FIG. 11 is a perspective view showing the displacement restriction structure for the coupling member 75L.

The frame 12 has a rectangular cutout 12*b* at the left end thereof. A rib 76*e* is provided on the bottom surface of the main member 76 of the coupling member 75L. Note that the coupling member 75R does not have the rib 76*e*. The rib 76*e* is inserted into the cutout 12*b*, and the peripheral edge of the cutout 12*b* and the rib 76*e* interfere with each other. Thus, the coupling member 75L is restricted from being displaced in the X direction (particularly in the forward direction).

Figure 12:
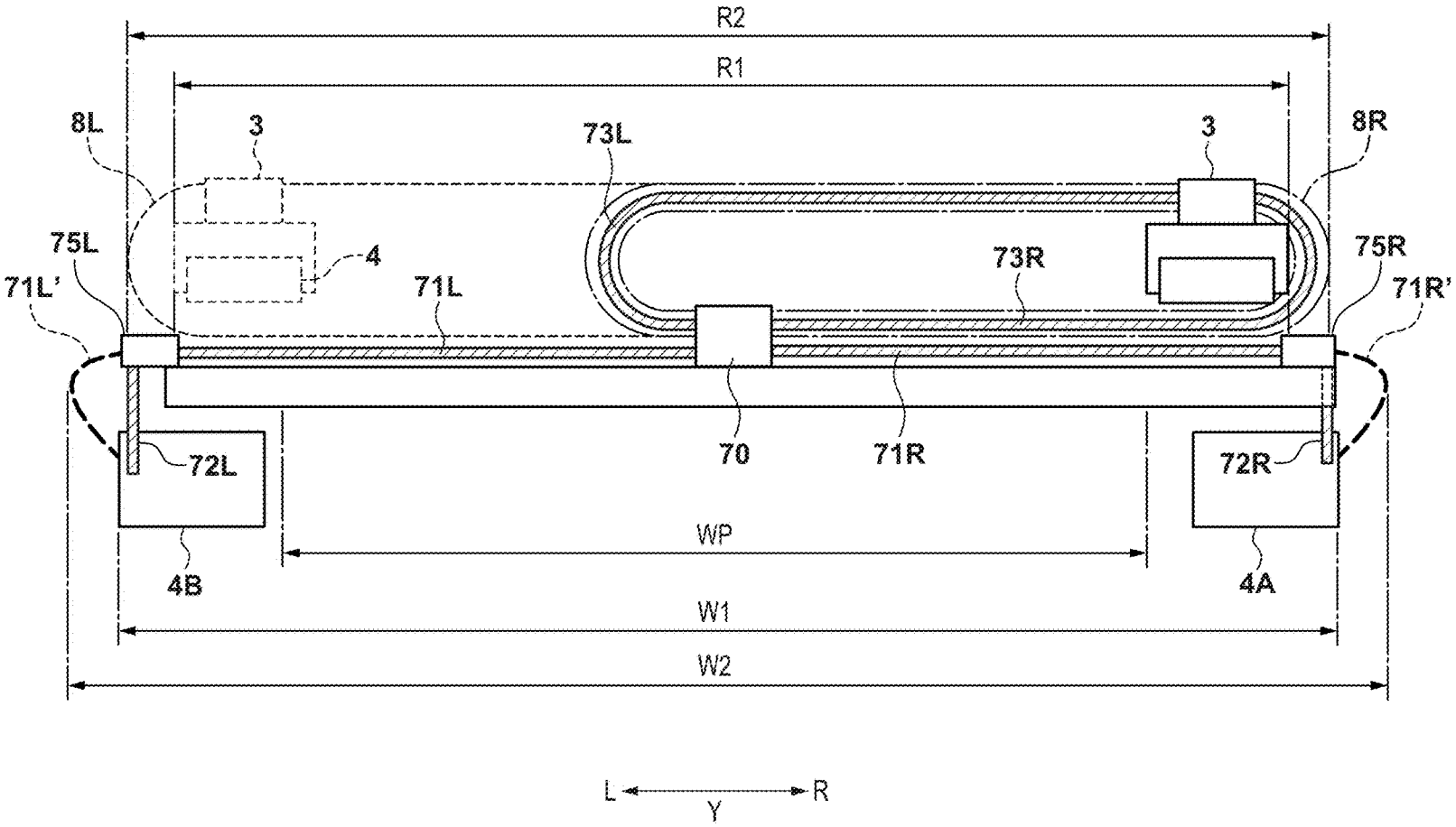
FIG. 12 is a diagram illustrating the arrangement of the left and right coupling members.
Figure 13:
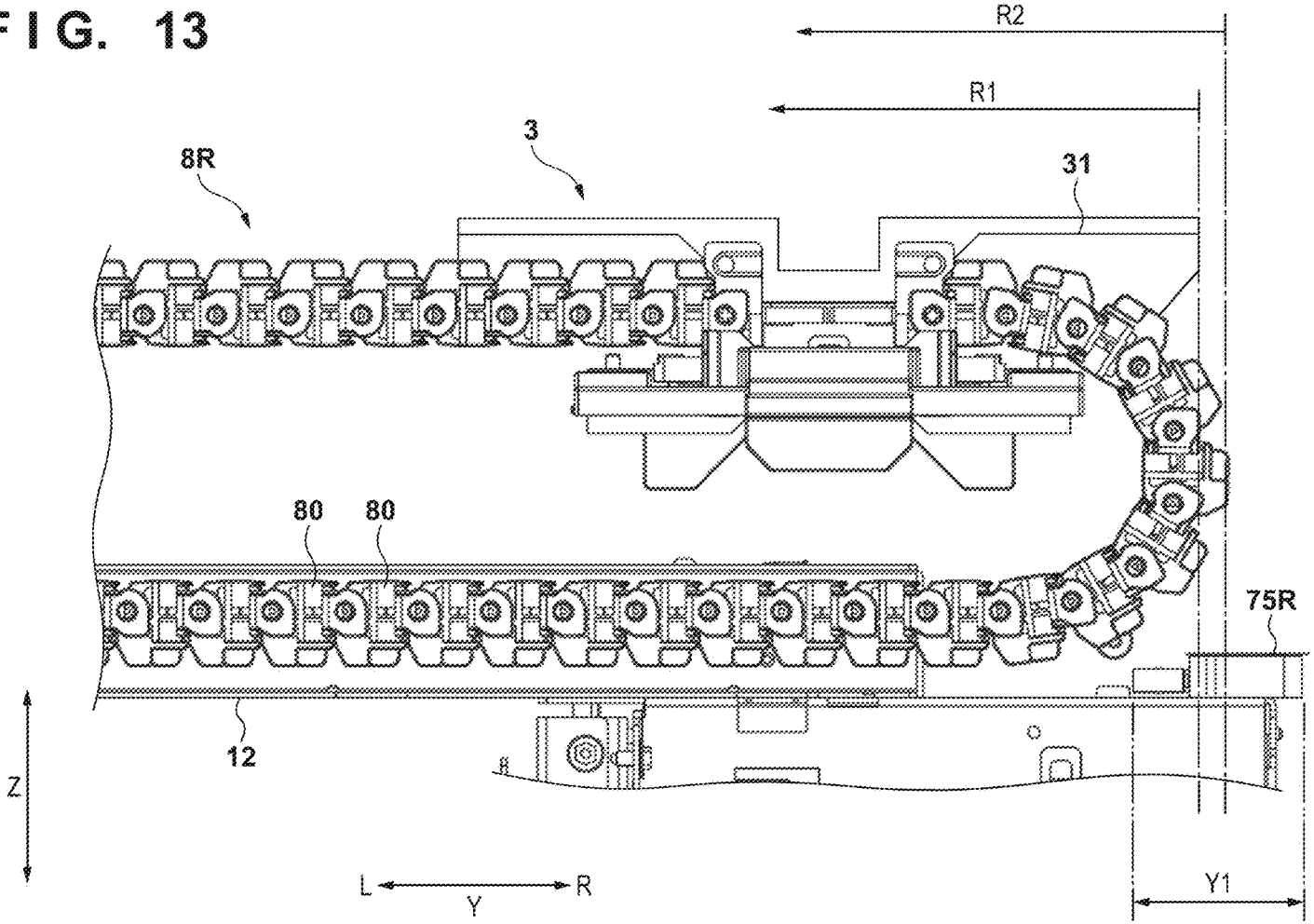
FIG. 13 is a diagram illustrating the arrangement of the right coupling member.

Next, the positions of the coupling members 75R and 75L will be described with reference to FIGS. 12 and 13. FIG. 12 schematically shows the positions of the coupling members 75R and 75L, and FIG. 13 shows the position of the coupling member 75R.

The coupling member 75R is located in the right end portion 1*a* (see FIG. 1) of the printing apparatus 1, and the coupling member 75L is located in the left end portion 1*b* (see FIG. 1) of the printing apparatus 1. Both the coupling member 75R and the coupling member 75L are located outside a width WP of the conveyance system of the printing apparatus 1 (the maximum width of available printing media) in the Y direction. Note that the coupling member 75R may be located within the range of 1/8, 1/16, or 1/32 the apparatus's width W, from the right end of the printing apparatus 1, for example. Similarly, the coupling member 75L may be located within the range of 1/8, 1/16, or 1/32 the apparatus's width W, from the left end of the printing apparatus 1, for example.

The coupling members 75R and 75L allow the tubes to change their orientation by a sharp angle at the positions where the coupling members 75R and the 75L are located, which makes it possible to downsize the printing apparatus 1 in the Y direction.

Specifically, in the present embodiment, the tubes 71R extend in the Y direction, whereas the tubes 72R extend from the tubes 71R in a direction that is substantially orthogonal to the tubes 71R. If the coupling member 75R is not intervened and the tubes 71R and the tubes 72R are replaced with tubes 71R', the tubes 71R' need to be looped so as to protrude outward in the Y direction as indicated by dotted lines in FIG. 12. If thick and hard tubes are used as the tubes 71R', the amount of this loop will be large. Similarly, if the coupling member 75L is not intervened and the tubes 71L and the tubes 72L are replaced with tubes 71L', the tubes 71L' need to be looped so as to protrude outward in the Y direction as indicated by dotted lines in FIG. 12.

When the coupling members 75R and 75L are used, the width of the apparatus excluding the outer casing is the width W1. On the other hand, when the coupling members 75R and 75L are not used, the width of the apparatus is the width W2 (>W1). In this way, using the coupling members 75R an 75L makes it possible to employ thick hard tubes, and to downsize the printing apparatus 1.

Next, in FIG. 12, a range R1 indicates the range of movement of the carriage 3, and a range R2 indicates the range of movement of the tube holding members 8R and 8L. In the present embodiment, the positions of the coupling members 75R and 75L in the Y direction overlap the range R1 and the range R2. FIG. 13 more specifically shows the position of the coupling member 75R. In the example shown in the drawing, the carriage 3 is located at the right end of the range R1. The tube holding member 8R is also located at the right end of the range R2. The position of the right end of the guide portion 31 of the carriage 3 is the position of the rightmost end of the carriage 3. It can be understood that a portion of the coupling member 75R and the guide portion 31 overlap each other when viewed in the Z direction. That is, the position (Y1) of the coupling member 75R in the Y direction overlaps the range R1. Also, the position of the right end of the curve of the tube holding member 8R is the position of the rightmost end of the tube holding member 8R. It can be understood that a portion of the coupling member 75R and the tube holding member 8R overlap each other when viewed in the Z direction. That is, the position (Y1) of the coupling member 75R in the Y direction overlaps the range R2. The same applies to the positional relationship between the coupling member 75L and the ranges R1 and R2.

With such a configuration, in the present embodiment, it is possible to approximate the range of movement R1 of the carriage 3 and the range of movement R2 of the tube holding members 8R and 8L to the width W of the printing apparatus 1. The range of movement of the carriage 3 or the like within the apparatus's width corresponds to the width of an available printing medium, and cannot be reduced. However, this range of movement approximates to the apparatus's width, and this means that there is no wasted space in the width direction of the printing apparatus 1. That is, it is possible to provide a user with the printing apparatus 1 that is downsized in the width direction.

Other Embodiments

In the above-described embodiment, the ink supply units 4A and 4B are located rearward of the carriage 3. However, such a configuration is not essential, and the ink supply units 4A and 4B may be located downward or forward of the carriage 3. Although the tubes 72R and 72L extend rearward from the corresponding coupling members 75R and 75L, the tubes 72R and 72L may extend downward or forward depending on the positions of the ink supply units 4A and 4B.

The method employed to supply ink from the ink supply units 4A and 4B to the printhead 2 may be a method utilizing a difference between hydraulic heads, or another method (e.g. a pressurizing method).

In the above-described embodiment, chain links are used as the tube holding members 8R and 8L. However, other holding members (e.g. resin sheets or leaf springs) may be used. Also, it is possible to employ a configuration in which no tube holding member is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-114552, filed Jun. 9, 2017, which is hereby incorporated by reference herein in its entirety.

What is claimed is:

1. A printing apparatus comprising:

a printhead configured to perform printing by discharging ink onto a printing medium;

a carriage, on which the printhead is mounted, configured to reciprocate;

a first containing unit configured to contain ink to be supplied to the printhead; and a channel forming unit configured to form an ink supply channel for supplying ink to the printhead, wherein the channel forming unit includes:

a first tube which extends in a reciprocation direction of the carriage;

a second tube which is connected to the first containing unit; and a first coupling member which couples the first tube and the second tube to each other, and wherein the first coupling member is located in one end portion of the printing apparatus in the reciprocation direction, and includes a bent channel which communicates the first tube and the second tube to each other.

2. The printing apparatus according to claim 1, wherein the channel forming unit includes a third tube which is connected to the carriage, the printing apparatus further comprises a tube holding member which is connected to the carriage, and is configured to move together with the carriage while holding the third tube, and a position of the first coupling member in the reciprocation direction overlaps a moving range of the tube holding member.

3. The printing apparatus according to claim 2, wherein the tube holding member is a chain link which includes a plurality of link members which are coupled to each other.

4. The printing apparatus according to claim 1, wherein a position of the first coupling member in the reciprocation direction overlaps a moving range of the carriage.

5. The printing apparatus according to claim 1, wherein the reciprocation direction is a left-right direction of the printing apparatus, the first containing unit is located at an rear side of the printing apparatus rather than the carriage, and the second tube extends from the first coupling member to the rear side of the printing apparatus.

6. The printing apparatus according to claim 1, wherein the first coupling member includes:

a first connection portion to which the first tube is connected; and a second connection portion to which the second tube is connected, a direction in which the first connection portion is connected is the reciprocation direction, and a direction in which the second connection portion is connected is a direction which intersects the reciprocation direction.

7. The printing apparatus according to claim 1, wherein the first coupling member includes:

a first member to which the first tube is connected; and a second member to which the second tube is connected, and wherein the first member and the second member are configured to be separable from each other in the reciprocation direction.

8. The printing apparatus according to claim 1, further comprising:

a cover member which forms an outer casing of the printing apparatus, wherein the first coupling member is located so as to be exposed when the cover member is removed.

9. The printing apparatus according to claim 1, further comprising:

a second containing unit configured to contain ink to be supplied to the printhead, wherein the channel forming unit includes:

a fourth tube which extends in the reciprocation direction;

a fifth tube which is connected to the second containing unit; and a second coupling member which couples the fourth tube and the fifth tube to each other, and wherein the second coupling member is located in the other end portion of the printing apparatus in the reciprocation direction, and has a bent channel that connects the fourth tube and the fifth tube to each other.

10. The printing apparatus according to claim 1, further comprising:

a restriction unit configured to restrict the first tube from being displaced in a direction that intersects the reciprocation direction.

11. The printing apparatus according to claim 1, wherein the first coupling member is configured to be displaceable in the reciprocation direction.

12. The printing apparatus according to claim 1, further comprising:

a restriction unit configured to restrict the first coupling member from being displaced in a direction that intersects the reciprocation direction.

13. The printing apparatus according to claim 1, wherein the first tube has a larger channel diameter and/or higher gas barrier properties than the second tube.

* * * * *